US005638601A

United States Patent [19]

Mol et al.

[11] Patent Number: 5,638,601

[45] Date of Patent: Jun. 17, 1997

[54] SHAVER AND METHOD FOR DISPENSING AND DISTRIBUTING SHAVING CREAM AND GEL

[76] Inventors: Jan M. Mol; Dorota W. Mol, both of 9581 Dee Rd. Apt. 2D, Des Plaines, Ill. 60016

[21] Appl. No.: 378,183

[22] Filed: Jan. 25, 1995

[51] Int. Cl.[6] ..... B26B 21/44

[52] U.S. Cl. ..... 30/41; 30/541

[58] Field of Search ..... 30/41, 90, 47, 30/84, 86, 541

[56] References Cited

U.S. PATENT DOCUMENTS

| | | | |
|---|---|---|---|
| 1,333,306 | 3/1920 | Gill et al. | 30/41 |
| 2,839,224 | 6/1958 | Lipka | 222/191 |
| 3,703,765 | 11/1972 | Penez | 30/41 |
| 4,077,119 | 3/1978 | Sellera | 30/41 |
| 4,653,188 | 3/1987 | Kwak | 30/41 |
| 4,809,432 | 3/1989 | Schauble | 30/41 |
| 5,036,587 | 8/1991 | Trotta et al. | 30/41 |
| 5,072,512 | 12/1991 | Noujain | 30/41.5 |
| 5,337,478 | 8/1994 | Cohen et al. | 30/41.5 |

FOREIGN PATENT DOCUMENTS

| | | | |
|---|---|---|---|
| 1807236 | 8/1969 | Germany | 30/41 |

*Primary Examiner*—Douglas D. Watts
*Attorney, Agent, or Firm*—Arnold, White & Durkee

[57] ABSTRACT

An improved shaver includes a plate having a substantially flat spreading surface for spreading shaving cream or gel onto an area to be shaved to form a thin substantially uniform layer of shaving cream or gel. The substantially flat spreading surface is preferably as wide as the shaving head and long enough to avoid the shaving cream foam flowing over the bottom of the plate. The shaver preferably includes a chamber for storing the shaving cream and a mechanism for dispensing it onto the substantially flat spreading surface at a preselected rate. The substantially flat surface can include flat parallel projections that are spaced apart from each other. These projections facilitate spreading of the cream or gel. The substantially flat spreading surface can be subdivided into a plurality of articulated panels which can be folded over the shaving head to protect the razor blade.

23 Claims, 2 Drawing Sheets

SHAVER AND METHOD FOR DISPENSING AND DISTRIBUTING SHAVING CREAM AND GEL

FIELD OF THE INVENTION

This invention relates to an improved shaver capable of dispensing and distributing shaving cream and gel onto an area to be shaved and to a method for dispensing and distributing shaving cream and gel.

BACKGROUND OF THE INVENTION

One traditional approach to dispensing and applying shaving cream or gel from a pressurized container is to dispense the cream or gel directly onto an area to be shaved and then to spread it by hand it so as to cover the entire area to be shaved. The shaving cream or gel often includes ingredients that soften the hair and condition the skin in the area to which the cream or gel is applied so as to provide a smoother shave. Once spread on the area to be shaved, the cream or gel marks this area as the area to be shaved. The user of the shaver can then clearly see which part of the area has been shaved and which part remains to be shaved.

The problem with this traditional approach is that the user has to remember to carry with him a can of pressurized shaving cream or gel, in addition to his shaver. Another problem with this approach is that the user has to put his hand into the cream or gel in order to spread it.

A number of prior art patents have attempted to address the first of the two problems inherent in the traditional approach by providing a shaving cream in a container that is an integral part of a shaving device. For example, U.S. Pat. No. 2,839,224 (Lipka) discloses a razor provided with a shaving cream dispenser which is located in an elongated handle. The handle includes a chamber for shaving cream, which communicates with the narrow slots 29 on narrow curved sides 20 of the razor head. A valve mechanisms is provided to move the shaving cream from the chamber onto the curved edge 20. The shaving cream is emitted from the edge 20 immediately in front of the razor blade so that no further spreading of the shaving cream is effected. See e.g. column 2, lines 63–68. The problem with the approach disclosed in the Lipka patent is that the cream is dispensed immediately before the area is shaved. Since the cream stays on the skin for only a moment, there is no time for it to soften the hair or to condition the skin in the area to be shaved. There is simply no time to soften and condition the area to be shaved prior to action of the razor blade. In addition, since the cream is applied only to an area immediately in front of the razor, the area to be shaved is not marked. As the result, it is easy to miss spots and difficult to make sure that the entire area that needed to be shaved was in fact shaved.

U.S. Pat. No. 4,653,188 (Kwak) discloses a shaver containing a shaving cream dispenser in a chamber in its handle. A slidable member on the handle is moved to push the shaving cream out onto the head of the shaver. As in the Lipka patent, the shaving cream is dispensed shortly before the action of the razor blade. Accordingly, the device disclosed in the Kwak patent suffers from the same disadvantages as those inherent in the Lipka patent.

U.S. Pat. No. 4,809,432 (Schauble) discloses a disposable razor and emollient dispensing device. The emollient is held in the handle of the device and its flow is controlled by a control mechanism. When the control mechanism is activated, the emollient flows onto the razor head (236 in FIG. 7) and is applied onto the surface to be shaved immediately before the razor shaves that area. Thus, the Schauble approach is also similar to the approach of the Lipka patent and suffers from the same disadvantages.

U.S. Pat. No. 5,072,512 (Noujain) discloses a razor with an internal reservoir containing a metal lubricant. The metal lubricant is dispensed directly onto the razor blade and coats the blade with the lubricant. The disclosure of the Noujain patent to apply a lubricant directly onto the blade rather than spreading it on the surface to be shaved is similar to the approach of the Lipka patent and suffers from the same disadvantages.

U.S. Pat. No. 4,077,119 (Sellera) discloses a shaving device which includes a holder for a razor blade. The holder includes a receptacle in a handle for holding and releasing pressurized shaving cream. The released shaving cream is dispensed onto the shaving head immediately in front of the razor blade. Accordingly, the Sellera approach suffers from the disadvantages of the Lipka patent as well.

U.S. Pat. No. 5,337,478 (Cohen et al.) discloses an automatic shaving device which includes a handle. The handle houses a pressurized foam dispenser and an electric valve controller the for releasing shaving foam from the foam dispenser onto the head assembly. The release of the shaving foam can be effected by placement of the shaving head against the surface being shaved. The foam is dispensed through a dispensing slot 25 in front of the razor blade assembly 17. The head also includes a plurality of lotion dispensing apertures 26 for releasing lotion from the lotion conduit 24. Accordingly, the approach disclosed in the Cohen et al. patent suffers from the same disadvantages as the Lipka patent.

There is, therefore, a long-felt unfulfilled need for a method and a shaver capable of efficient spreading and/or dispensing shaving cream or gel on the area to be shaved, which do not suffer from the disadvantages inherent in the prior art.

SUMMARY OF THE INVENTION

Shaving cream or gel can be efficiently dispensed and distributed over the area to be shaved by dispensing cream onto a relatively large plate having a substantially flat surface and then distributing the dispensed cream onto the area to be shaved using said substantially flat spreading surface. The use of a thin substantially flat surface provides an additional advantage. The space on the side of the plate opposite to the substantially flat surface can retain large amounts of shaved-off cream or gel without the need to rinse it off.

In accordance with one aspect of the present invention, an efficient, inexpensive to manufacture, and reliable mechanism for dispensing shaving cream includes a tube extending through a passageway into a chamber in the handle of a shaver. The passageway communicates with the openings on the substantially flat spreading surface. The passageway is selectively opened and closed by moving an actuator slidably mounted on the shaver. The length and the inner diameter of the tube are selected to automatically control the rate of flow of the cream onto the substantially flat spreading surface.

In accordance with another aspect of the present invention, a plurality of thin substantially parallel and spaced apart from each other elements are attached to the substantially flat spreading surface. These elements facilitate even and efficient spreading of the shaving cream onto the area to be shaved.

In accordance with still another aspect of the present invention, a plate having a substantially flat spreading surface is integrally incorporated into a standard disposable razor assembly and used to spread shaving cream dispensed from a traditional shaving cream dispenser.

In accordance with a further aspect of the present invention, a plate having a substantially flat spreading surface is provided with an adhesive for mounting it onto a traditional shaver so that the mounted plate can be used for spreading the shaving cream or gel.

In accordance with a still further aspect of the present invention, a plate is subdivided into panels and one end of the plate is rotatably mounted on the head of a shaver. The free end of the plate can be rotated around the rotatably mounted end so that the panels fold over the razor head to protect a razor blade. When the free end is rotated onto the back of the shaving head and affixed to the handle, the panels define a substantially flat spreading surface for spreading shaving cream and gel.

In accordance with still another aspect of the present invention, a method for distributing shaving cream or gel includes the step of applying the cream or gel onto the area to be shaved and spreading it to form a thin substantially uniform layer using a flat spreading surface of a plate.

Other aspects advantages and features of the present invention will become apparent to those skilled in the art upon studying this disclosure. All such aspects, advantages and features of the present invention are intended to be included within the scope of the claimed invention.

DETAILED DESCRIPTION

Figures 1, 2, 3, 4, 5:
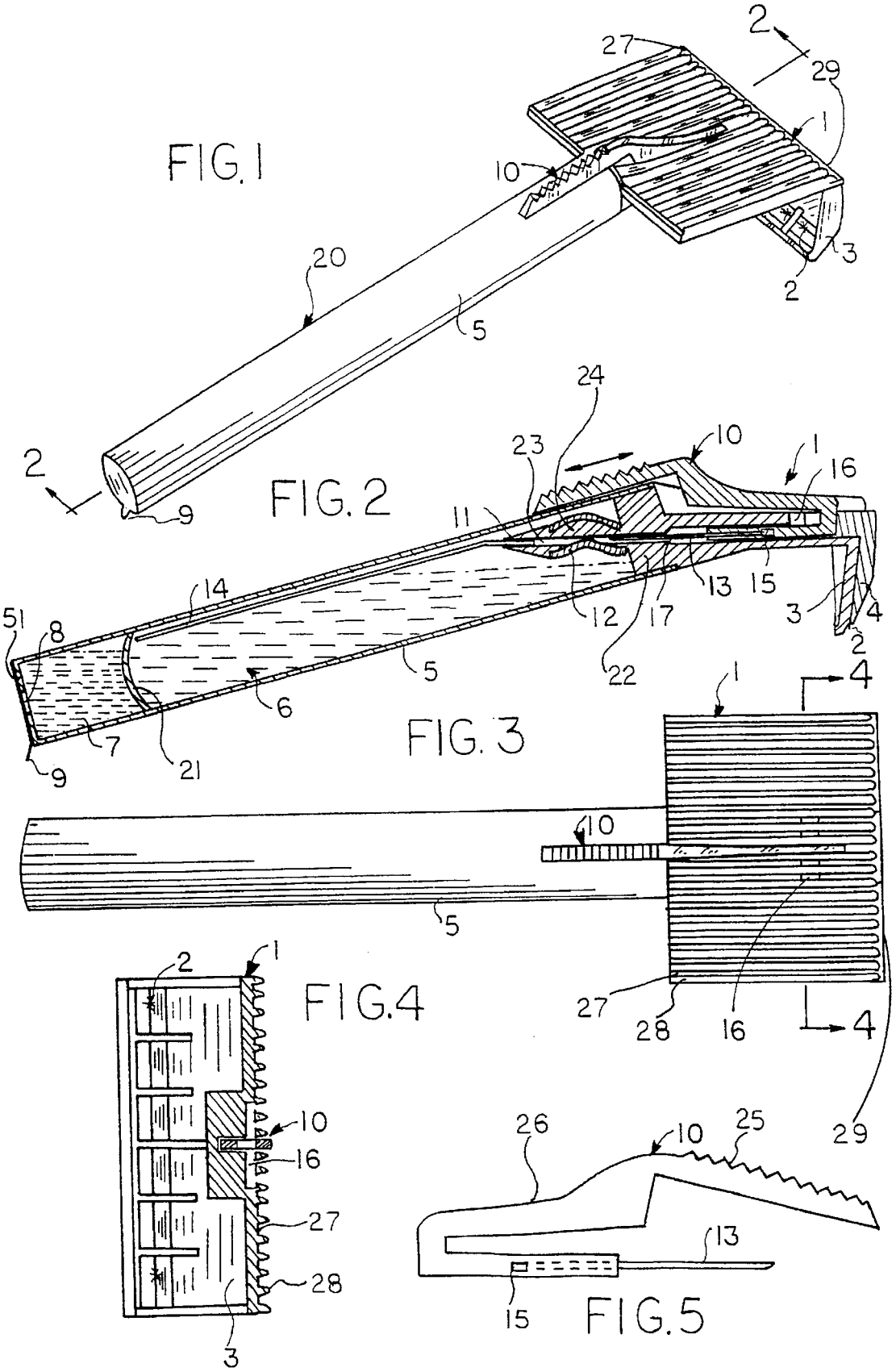
FIG. 1 is a perspective view of an improved shaver constructed in accordance with the currently preferred embodiment of the present invention.
FIG. 2 is a cross-sectional view of the improved shaver of FIG. 1 taken along line 2—2 thereof.
FIG. 3 is a planar view of the improved shaver of FIG. 1.
FIG. 4 is a cross-sectional view of the improved shaver of FIG. 3 taken along line 4—4 thereof.
FIG. 5 is a side elevational view of the actuator included in the improved shaver of FIG. 1.

The present invention provides an improved shaver and an improved method for efficient dispensing of shaving cream and/or for distributing shaving cream or a gel to cover the area to be shaved with a thin substantially uniform layer of shaving cream or gel. In accordance with the present invention, a plate having a substantially flat spreading surface is provided for spreading the shaving cream or gel that either had been dispensed onto the flat surface from the shaving assembly or had been applied directly to the area to be shaved. The plate is preferably thin enough to permit accumulation of the shaved off cream behind it but thick enough to maintain its structural integrity. Generally, its thickness should be in the range from about 0.5 mm to 0.1 mm, most preferably between about 0.2 mm and about 0.3 mm. As used herein the term "substantially flat surface" means that a surface which has an aspect ratio from about 1.0 to about 1.2, the aspect ratio being defined as the ratio of the actual area of the surface to the area of the projection of the actual surface taken in the direction generally normal to the middle of the actual surface. For purposes of determining the aspect ratio, the actual area is the overall area rather than surface area of ridges and other small surface adulations. 0f course, a plate having an aspect ratio of 1.0 is flat. Accordingly, the term "substantially flat surface" encompasses a flat surface as well. The plate can have different shapes. However, it has been found that particularly good results are obtained when the plate is generally rectangular in shape. The length of the plate, i.e., the distance from the top edge near the head of the shaver to be bottom edge extending toward the free end of handle in generally long enough to prevent the shaving cream from flowing over the bottom edge of the plate when the cream is being spread. The length of the plate is generally short enough to permit efficient spreading of the cream. Generally, the plates having substantially rectangular shape have the length of about 2 cm to about 5 cm, preferably about 3 cm to about 4 cm The area of the plate is generally in the range of about 7 $cm^2$ to about 25 $cm^2$. The plate can be made of any material that maintains its structural integrity; however, it is preferably made of plastics such as those used for making disposable plastic razors. The width of the plate is preferably about the same as the width of the razor head. However, the plate can be smaller or larger than the razor head. Generally, the width of the plate is in the range from about 4 cm to about 5 cm.

The plate preferably includes a plurality of thin substantially parallel projections spaced apart from each other adjacent to and mounted on its substantially flat surface. The projections facilitate the control of spreading the shaving cream onto the area to be shaved. The substantially flat spreading surface is preferably located on a razor or shaver head in a location which allows spreading the cream without a possibility of an accidental engagement of the razor blade with the skin. Generally, the substantially flat spreading surface is located on the side of the razor or shaver head that is opposite to the side that contains the razor blade or blades. It should be noted that the plate of the present invention can be used with razors or shavers which have one, two or more razor blades. In addition, the shaving head may not have in it a razor blade during spreading of the cream. It is preferred, however, to have at least one razor blade in the razor head during spreading of the cream.

The shaving cream can be located in a pressurized chamber inside the handle of the razor assembly and is dispensed onto the substantially flat spreading surface through at least one opening therein. An actuating mechanisms for controlling dispensing of the cream includes a tube having a first end extending into the chamber in the handle of the shaver assembly. The chamber contains the pressurized shaving cream. A sliding element having a finger is mounted on the razor head in such a manner that its finger opens and closes the passageway that provides communication between the tube and the opening or openings on the substantially flat spreading surface. The handle can also include an enclosed space for storing an after-shave lotion or other liquids helpful for conditioning the hair and/or skin in the area to be shaved or for conditioning skin in the area that has been shaved. For a given shaving cream, the rate at which the shaving cream is dispensed can be predetermined by selecting the length of the tube and the inner diameter of the tube. Generally, the length of the tube is in the range from about 3 cm to about 8 cm, preferably from about 4 cm to about 7 cm. The inner diameter of the tube is generally in the range from about 0.5 mm to about 1 mm, preferably about 0.7 mm. It has been found that it is preferred to dispense 50 to 60 $cm^3$ of the shaving cream in about 7 to 15 seconds.

The plate can be subdivided into a plurality of articulated panels. The top edge of the plate can be rotatably mounted onto the head of the razor. The bottom edge can be rotated to cause the panels to articulate and fold over the razor blade to protect the blade from coming in contact with objects and thereby maintain in a clean, sharp condition. When the articulated panels are folded over the razor blade, they also serve as a safety feature for protecting the user from accidental cuts when the shaving assembly is stored. In its extended position, the articulated panels form a substantially flat spreading surface for spreading shaving cream or gel.

The construction and operation of several embodiments of the present invention will now be described in connection with the drawings. The following description and the drawings are intended to illustrate the invention and to explain its operation but they are not intended to limit the invention to the embodiments or to the operations shown in the drawings.

The currently preferred embodiment of the present invention is shown in FIGS. 1–5. Referring now to FIG. 1, shown there is a razor or shaver generally designated by a numeral 20. The razor 20 includes a plate generally designated by a numeral 1. The plate 1 includes a substantially flat surface 27. As shown in FIGS. 1 and 2, the plate 1 is rectangular in shape. The plate 1 is made of plastic. A plurality of projecting comb-like elements 28 are attached to the surface 27. As shown in FIG. 1 and FIG. 3, the elements 28 are parallel to each other and spaced apart by a distance slightly less than the thickness of the elements. The elements 28 extend near (within about 1.5 mm), but not to the top end 29 of the surface 27.

The razor 20 includes an elongated tubular handle 5. As shown in FIG. 2, the inner wall of the handle 5 defines a chamber 6 which contains pressurized shaving cream. The chamber 6 is further defined by an end cap 21 at one end and a plug 22 on the other end. The plug 22 includes a projecting portion 24 and a tapered portion 11. A flexible rubber tube 12 fits around the projecting portion 24. A tube 14 having a first end extending toward the end cap 21 and a second end extending into a passageway 23 in the plug 22. As shown in FIG. 1, a slide element 10 having a finger 13 is slidably mounted in such a way so that the finger 13 extends through a passageway 17 into the passageway 23. The slide element 10 is shown in FIG. 5. As shown in FIG. 5 and also as can be seen in FIGS. 1, 2 and 3, the plug 10 includes a serrated portion 25 and a generally U-shaped portion 26. The finger 13 extends into the U-shaped portion 26 and is affixed thereto. The finger 13 is made of a tube made of metal. The inner diameter of the tube formerly the finger 13 is 0.7 mm. The inner diameter of the tube of the finger 13 communicates with an opening 15 in the U-shaped portion 26.

As shown in FIGS. 1, 2 and 4, the razor head 3 accommodates a razor blade 2 under the front section 4. As shown in FIG. 2, the handle 5 includes a second chamber 7 for holding an after-shave lotion or conditioners that are useful for shaving. The second chamber 7 is defined by the inner wall of the handle 5 and end wall 51 and the end cap 21. The wall 51 has an opening 8 therein which is covered by a tab 9. The access to the after-shave or a conditioner is obtained by removing a tab 9 from the end wall 51.

In operation, to dispense shaving cream from the chamber 6, the user places his finger on the serrated portion 25 of the razor 20. He slides the element 10 which causes the finger 13 to move aside the rubber tube 12, thereby opening the passageway 23. When the passageway 23 is opened, the shaving cream flows from the chamber 6 through the tube 14, through the passageway 17, the passageway 23, inside the tube of the finger 13 and through the openings 16 and exits onto the surface 27.

When a sufficient amount of shaving cream is dispensed, the plug 10 is slid back to its original position. This sliding movement causes the rubber tube 12 to resiliently move back, closing of the passageway 23 leading to the opening 16 and stops the flow of the shaving cream from the chamber 6 in the handle 5.

Figure 6:
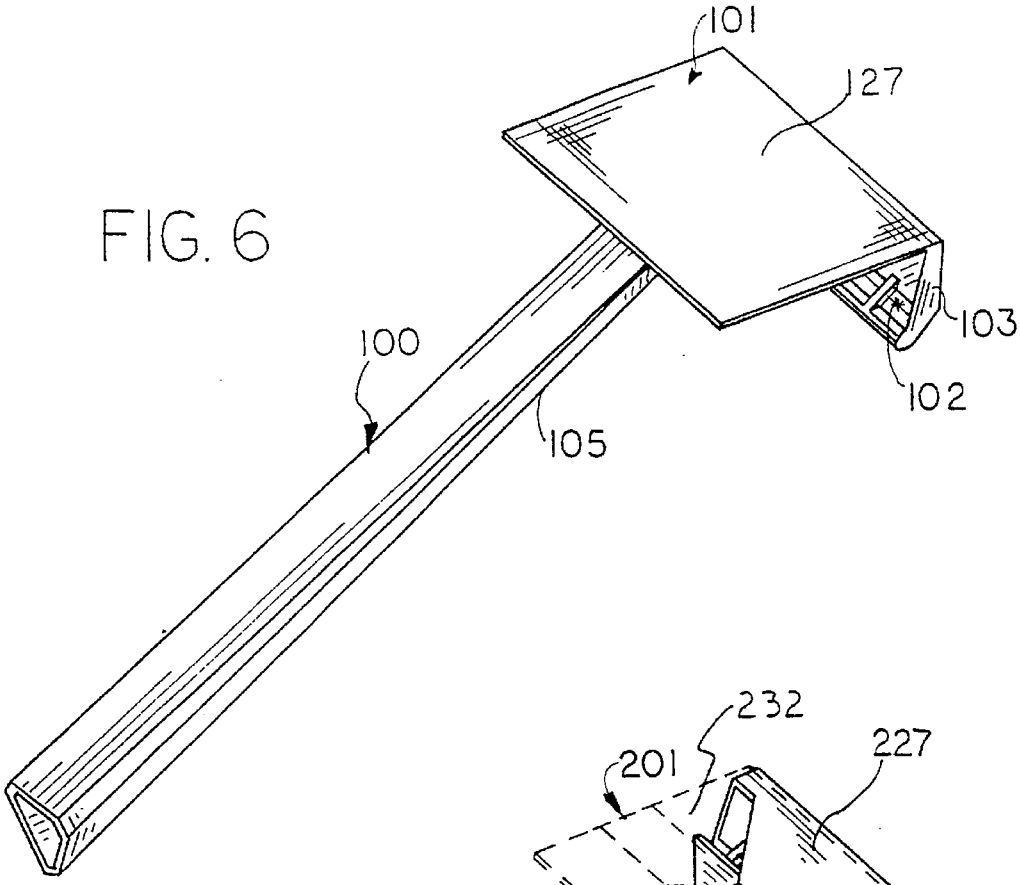
FIG. 6 is a perspective view of an improved shaver constructed in accordance with another embodiment of the present invention.

The improved shaver shown in FIG. 6 includes a razor head 103. The razor head 103 holds a razor 102. A plate 101 having a substantially flat rectangular surface 127 is integrally connected to the razor head 103 and a handle 105. In operation, the shaving cream or gel is dispensed onto the area to be shaved and distributed using the flat surface 127. In the alternative, the cream or gel can be dispensed onto the flat surface 127 and then distributed onto the area to be shaved using the flat surface 127.

Figure 7:
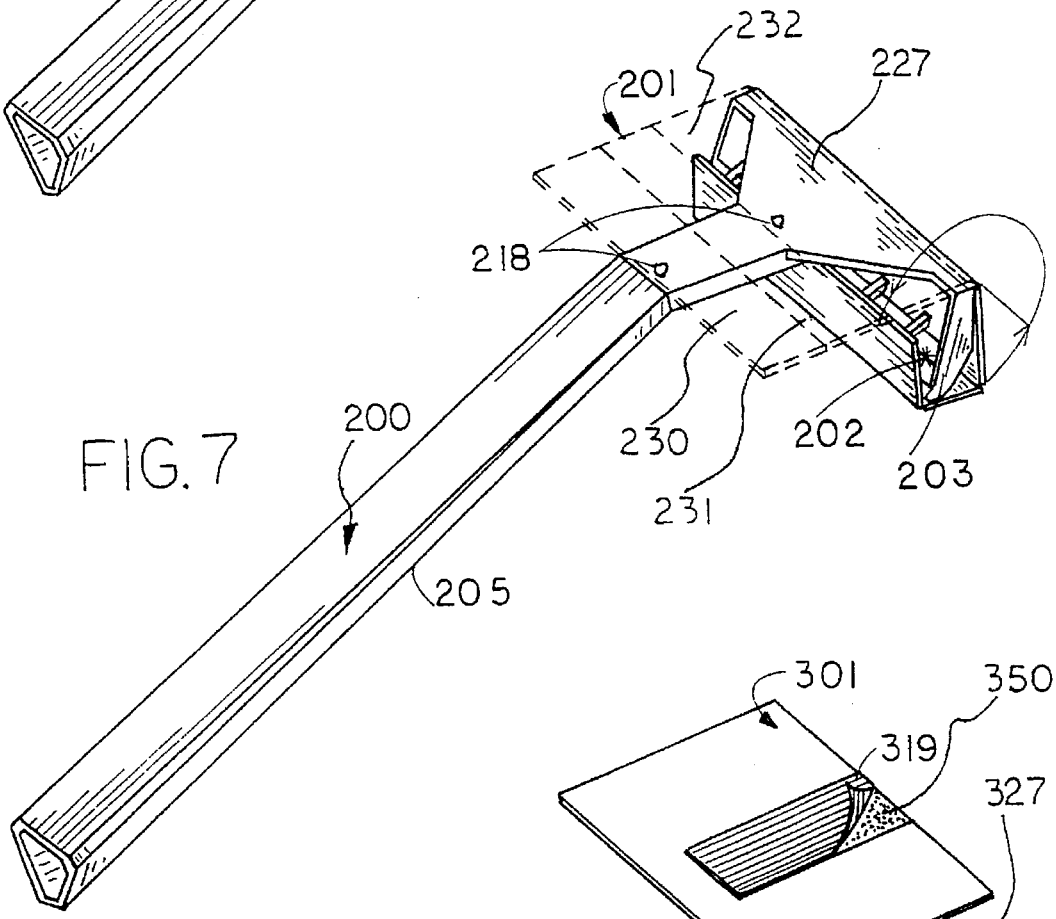
FIG. 7 is a perspective view of an improved shaver constructed in accordance with a further embodiment of the present invention with a flat spreading surface subdivided into panels which articulate and are folded over the razor blade to cover and protect the razor blade when the razor is not in use.

The shaver shown in FIG. 7 is generally designated by a numeral 200. The shaver 200 includes a head 203. The head 203 holds a blade 202. The head 203 is rigidly connected to a handle 205. A plate 201 can be positioned as shown in broken lines to form a plate having a substantially flat surface 227. The plate 201 includes three panels 230, 231, 232 which are connected to each other so that they can articulate and fold over to a position shown in solid lines FIG. 7. In the folded position, the folded plate 201 covers the razor blade 202. The folded plate 201 protects the razor blade 202 and prevents accidental cuts. To hold the plate 201 in the position shown in the broken lines in FIG. 7, snaps 218 are provided on the handle and on the panels. The operation of the razor 200 is substantially the same as that of the razor 100 of FIG. 6 when the plate 207 is in the extended position shown in broken lines in FIG. 7 and the panels 230, 231 and 232 are attached to the handle via snaps 218.

Figure 8:
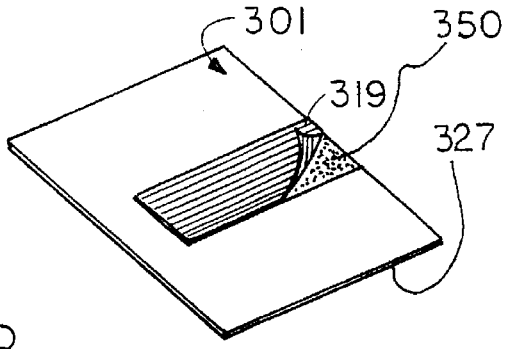
FIG. 8 is a substantially flat surface for spreading shaving cream constructed in accordance with the present invention, attachable by an adhesive to traditional razors.

The rectangular plate 301 shown in FIG. 8 is made of plastic. The plate 301 includes an adhesive 350 and a covering sheet 319. The adhesive 350 is used to attach the plate 301 to a handle of a standard shaver. The adhesive 350 is located on the opposite side of the plate 301 from the flat surface 327. Of course, the plate 301 can also be attached to the standard shaver by mechanical connectors, such as, screws, bolts or snaps.

We claim:

1. A shaver capable of dispensing and spreading shaving cream onto an area to be shaved, said shaver comprising:

a shaving head having a first portion for holding at least one razor blade and a second portion opposite to said first portion;

an elongated handle attached to the second portion of said shaving head;

a chamber inside said handle for holding pressurized shaving cream;

a plate having a substantially flat spreading surface, said plate attached to said handle and to the second portion of said shaving head, said substantially flat surface being generally perpendicular to the plane of the razor blade and having at least one opening therein;

an actuator for selectively opening and closing communication between said chamber and said opening so that when the communication is open the shaving cream flows from said chamber through said opening onto said substantially flat spreading surface so as to allow said shaving cream to be distributed into a thin uniform layer onto the shaved area using said substantially flat spreading surface.

2. The shaver of claim 1 further comprising a razor blade mounted in said shaving head.

3. The shaver of claim 1 further comprising two razor blades mounted in said shaving head.

4. The shaver of claim 1 wherein the plate is substantially rectangular.

5. The shaver of claim 1 wherein the plate is substantially as wide as the shaving head.

6. The shaver of claim 4 wherein the width of said plate is in the range from about 4 cm to about 5 cm.

7. The shaver of claim 4 wherein the length of said plate is in the range from about 2 cm to about 5 cm.

8. The shaver of claim 5 wherein the length of said plate is in the range from about 3 cm to about 4 cm.

9. The shaver of claim 4 wherein the thickness of said plate surface is from about 5 mm to about 0.1 mm.

10. The shaver of claim 1 wherein the plate has an area between about 7 $cm^2$ and 25 $cm^2$.

11. The device of claim 1 further comprising a plurality of projections adjacent said substantially flat surface and extending across said substantially flat surface, said projections being substantially parallel to each other spaced apart from each other so as to facilitate spreading of said shaving cream onto the area to be shaved.

12. An improved shaver capable of dispensing shaving cream and spreading it onto the area to be shaved, said shaver comprising:

a shaver head for holding at least one razor blade;

a handle having a chamber thereof for holding pressurizes shaving cream;

a plate having a substantially flat surface, said plate being attached to said handle and to said shaver head, said surface having at least one opening therein;

a tube extending into said chamber;

a passageway between said tube and said opening;

a flexible tube closing said passageway;

an actuator slidably mounted on said flat spreading surface and including a tubular finger, said tubular finger pushing aside the flexible tube when the actuator is slid into the open position to establish a communication between said chamber and said opening allowing the shaving cream to flow onto the substantially flat surface.

13. The improved shaver of claim 12 wherein the length of the tube and the inner diameter of the tube are selected to provide a flow rate of said shaving cream onto said surface.

14. The improved shaver of claim 12 wherein the length of said tube is in the range from about 3 cm to about 8 cm and the inner diameter of said tube is in the range from about 0.5 mm to about 1 mm.

15. An improved shaver capable of spreading shaving cream and gel onto the surface to be shaved, said shaver comprising:

a shaving head for holding at least one shaving blade, said shaving head having a shaving blade portion and an opposite portion;

a handle;

a plate having a substantially flat spreading surface attached to the opposite portion of said shaving head and to said handle, said spreading surface being generally perpendicular to the plane of the shaving blade, the length of said spreading surface being in the range from about 2 cm to about 5 cm and the width of said spreading surface being about the same as that of the shaving head.

16. The shaver of claim 15 wherein the substantially flat spreading surface is substantially rectangular.

17. An improved shaver capable of spreading shaving cream and gel onto an area to be shaved, said shaver comprising:

a shaving head;

a handle;

a substantially spreading surface, said spreading surface including a plurality of panels and having a first and a second end, said first end being rotatably mounted on said shaving head, said second end being removably attachable to said handle to form a substantially flat spreading surface and being movable so that the panels cover the blade in the second position.

18. The improved shaver of claim 17 wherein the surface is rectangular and has three panels.

19. The shaver claimed in claim 15 wherein the plate is attached to said head and to said handle by attaching means.

20. The spreading plate of claim 19 wherein means of attaching comprises an adhesive.

21. The shaver of claim 16 wherein, said plate has the width from about 4 cm to about 5 cm and is attached by an adhesive, said adhesive adapted to being covered by a removable layer prior to the plate being attached.

22. The spreading plate of claim 19 wherein means of attaching comprises a mechanical connector.

23. The rectangular plate of claim 19 wherein the width is in the range from about 4 cm to about 5 cm.

* * * * *